US008652739B2

(12) United States Patent
Kobayashi et al.

(10) Patent No.: US 8,652,739 B2
(45) Date of Patent: Feb. 18, 2014

(54) ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS AND IMAGE FORMING METHOD

(75) Inventors: Hiroko Kobayashi, Kanagawa (JP); Yasuhiro Arima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 241 days.

(21) Appl. No.: 13/024,115

(22) Filed: Feb. 9, 2011

(65) Prior Publication Data

US 2012/0070773 A1 Mar. 22, 2012

(30) Foreign Application Priority Data

Sep. 21, 2010 (JP) ..... 2010-210914

(51) Int. Cl.

| | |
|---|---|
| ***G03G 13/20*** | (2006.01) |
| ***G03G 13/08*** | (2006.01) |
| ***G03G 21/00*** | (2006.01) |

(52) U.S. Cl.
USPC ..... 430/124.1; 430/119.86; 430/123.51

(58) Field of Classification Search
USPC ..... 430/108.1, 108.6, 119.7, 119.82, 430/119.86, 124.1, 123.51
See application file for complete search history.

(56) References Cited

U.S. PATENT DOCUMENTS

2010/0080609 A1* 4/2010 Yoshino ..... 399/111

FOREIGN PATENT DOCUMENTS

| | | |
|---|---|---|
| JP | A-04-311971 | 11/1992 |
| JP | A-2009-151241 | 7/2009 |
| JP | A-2009-229919 | 10/2009 |
| JP | A-2010-060685 | 3/2010 |

* cited by examiner

*Primary Examiner* — Stewart Fraser
(74) *Attorney, Agent, or Firm* — Oliff & Berridge, PLC

(57) ABSTRACT

The present invention provides a toner for developing an electrostatic charge image including toner particles having residual ammonium ions and silica particles containing a chlorine compound as an external additive.

5 Claims, 2 Drawing Sheets

ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS AND IMAGE FORMING METHOD

CROSS-REFERENCE TO RELATED APPLICATION

This application is based on and claims priority under 35 USC 119 from Japanese Patent Application No. 2010-210914 filed Sep. 21, 2010.

BACKGROUND

1. Technical Field

The present invention relates to an electrostatic image developing toner, an electrostatic image developer, a toner cartridge, a process cartridge, an image forming apparatus and an image forming method.

2. Related Art

In recent years, image forming apparatuses such as printers and copying machines have come into widespread use, and technologies for various elements constituting the image forming apparatuses have also become widespread. Among image forming apparatuses, in an image forming apparatus using an electrophotographic system, often a photoreceptor such as a photoreceptor (image holding member) is charged using a charging unit, and an electrostatic latent image that has a different potential from the surrounding potential is formed on the charged photoreceptor, thereby forming a pattern to be printed. Subsequently, the electrostatic latent image is developed using a toner and ultimately transferred onto a recording medium such as a recording paper.

In the prior art, the technology for limiting the adhesion of nitrogen oxides by supplying heat generated from a heat fixing unit to a latent image support in the form of blowing hot air have been proposed.

Also, in the other prior arts, technologies for limiting the amount of ammonia and ammonium compounds present in a toner have been proposed.

SUMMARY

According to an aspect of the invention, a toner for developing an electrostatic charge image, including toner particles having residual ammonium ions and silica particles containing a chlorine compound as an external additive, is provided.

BRIEF DESCRIPTION OF THE DRAWINGS

Exemplary embodiments of the present invention will be described in detail based on the following figures, wherein.

DETAILED DESCRIPTION

Figure 1:
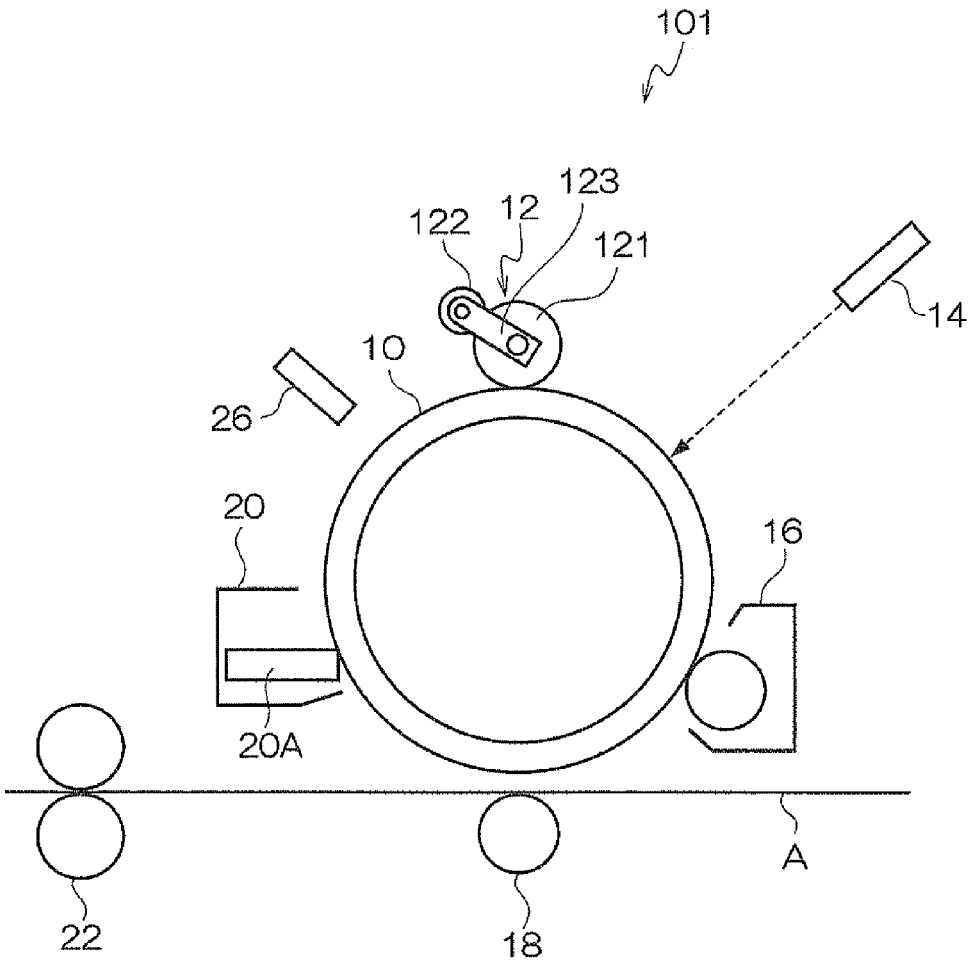
FIG. 1 is a diagram schematically illustrating the configuration of an image forming apparatus according to an exemplary embodiment of the invention.
Figure 2:
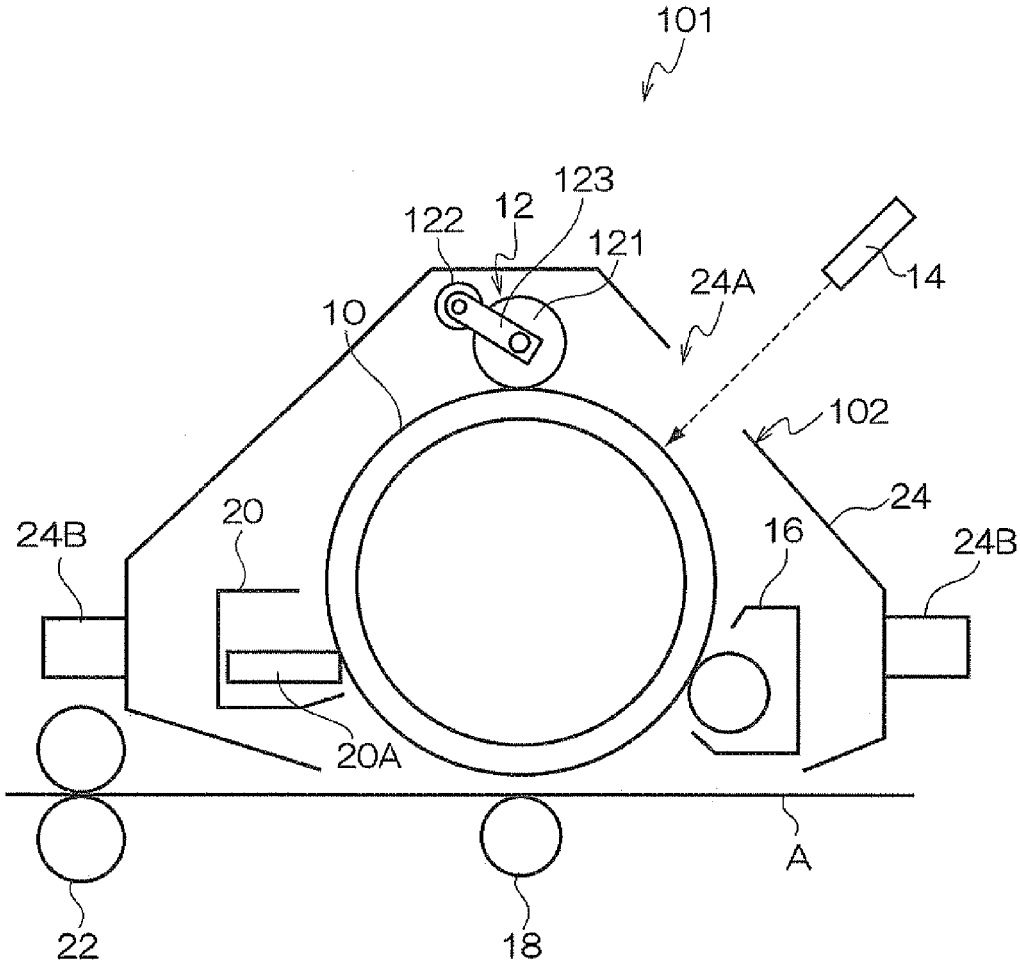
FIG. 2 is a diagram schematically illustrating the configuration of a process cartridge according to an exemplary embodiment of the invention.

Exemplary embodiments according to the aspect of the invention include, but are not limited to the following items <1> to <22>.

<1> A toner for developing an electrostatic charge image, including toner particles having residual ammonium ions and silica particles containing a chlorine compound as an external additive.

<2> The toner for developing an electrostatic charge image according to the item <1>, an amount of the residual ammonium ions being from 0.01 ppm to 20 ppm with respect to the toner particles.

<3> The toner for developing an electrostatic charge image according to the item <1> or the item <2>, the toner particles further including a pigment containing an azo group.

<4> The toner for developing an electrostatic charge image according to the item <3>, the pigment containing an azo group being C.I.Pigment Yellow 17 or C.I.Pigment Red 57:1.

<5> The toner for developing an electrostatic charge image according to the item <3> or the item <4>, a content of the pigment being about 1 part by weight to about 30 parts by weight with respect to 100 parts of a binder resin.

<6> The toner for developing an electrostatic charge image according to any one of the items <1> to <5>, the toner further including a release agent, and an amount of the release agent being about 1% by weight to about 15% by weight with respect to a total weight of the toner.

<7> The toner for developing an electrostatic charge image according to the item <6>, a melting temperature of the release agent being in a range of from about 50° C. to about 110° C.

<8> The toner for developing an electrostatic charge image according to any one of the items <1> to <7>, the chlorine compound including at least one of hydrochloric acid, chloric acid, chlorous acid, hydrochlorous acid, perchloric acid or chloroacetic acid.

<9> The toner for developing an electrostatic charge image according to any one of the items <1> to <8>, an external amount of the external additive being in a range of from about 0.5 parts by weight to about 2.5 parts by weight based on 100 parts by weight of the toner particles.

<10> A developer for an electrostatic charge image, including a carrier and the toner for developing an electrostatic charge image according to any one of the items <1> to <9>.

<11> A toner cartridge storing the toner for developing an electrostatic charge image according to any one of the items <1> to <9>, the toner cartridge being attached to and detached from an image forming apparatus.

<12> A process cartridge storing the developer for an electrostatic charge image according to the item <10>, the process cartridge including a developing unit that develops an electrostatic charge image formed on an image holding member as a toner image, and the process cartridge being attached to and detached from an image forming apparatus.

<13> An image forming apparatus including: an image holding member; a charging unit that charges a surface of the image holding member; an image forming unit that forms an electrostatic charge image on the surface of the image holding member charged by the charging unit; a developing unit that stores the developer for an electrostatic charge image according to the item <10>, and develops the electrostatic charge image formed on the image holding member as a developed toner image by the developer for an electrostatic charge image; a transfer unit that transfers the developed toner image formed on the image holding member onto a transfer-receiving body; and a fixing unit that fixes the transferred toner image transferred onto the transfer-receiving body.

<14> The image forming apparatus according to the item <13>, further including a cleaning unit including a cleaning blade that cleans the surface of the image holding member by contacting with the surface of the image holding member, a Si content in a deposited material which is deposited in a part of the cleaning blade that contacts with the image holding member being higher than a Si content in the toner for developing an electrostatic charge image.

<15> The image forming apparatus according to the item <14>, the Si content in the deposited material which is deposited in the part of the cleaning blade that contacts with the image holding member being at least two times higher than the Si content in the toner for developing an electrostatic charge image.

<16> The image forming apparatus according to any one of the items <13> to <15>, the charging unit including a contact-mode charging member having a surface layer including an epichlorohydrin rubber.

<17> The image forming apparatus according to the item <16>, the charging unit including a cleaning unit that contacts with a surface of the charging member and cleans the surface of the charging member.

<18> An image forming method including: charging a surface of an image holding member; forming an electrostatic charge image on the surface of the image holding member charged by the charging; developing the electrostatic charge image formed on the image holding member as a developed toner image by the developer for an electrostatic charge image according to the item <10>; transferring the developed toner image formed on the image holding member onto a transfer-receiving body; and fixing the transferred toner image transferred onto the transfer-receiving body.

<19> The image forming method according to the item <18>, further including cleaning the surface of the image holding member by a cleaning unit including a cleaning blade that contacts with the surface of the image holding member, a Si content in a deposited material which is deposited in a part of the cleaning blade that contacts with the image holding member being higher than a Si content in the toner for developing an electrostatic charge image.

<20> The image forming method according to the item <19>, the Si content in the deposited material which is deposited in the part of the cleaning blade that contacts with the image holding member being at least two times higher than the Si content in the toner for developing an electrostatic charge image.

<21> The image forming method according to any one of the items <18> to <20>, the charging being a charging that charges the surface of the image holding member via a contact-mode charging member having a surface layer including an epichlorohydrin rubber.

<22> The image forming method according to the item <21>, further including cleaning that cleans a surface of the charging member by using a cleaning member that contacts with the surface of the charging member.

An exemplary embodiment according to the invention is explained below with reference to the drawings.

FIG. 1 is a schematic structural view illustrating the configuration of an image forming apparatus according to this exemplary embodiment.

An image forming apparatus 101 according to this exemplary embodiment is, as shown in FIG. 1, provided with an image support 10 and, around the image support, a charging unit 12 (an example of the charging means) that charges a surface of the image support 10, an exposure unit 14 (an example of an electrostatic image forming means) that exposes the image support 10 charged by the charging unit 12 to light to form an electrostatic image (electrostatic latent image), a developing unit 16 (an example of a developing means) that stores an electrostatic image developer to develop the electrostatic image formed on the surface of the image support 10 as a toner image by the electrostatic image developer, a transfer unit 18 that transfers the toner image formed by the developing unit 16 to a transfer material A and a cleaning unit 20 (an example of a cleaning means) that cleans the surface of the image support after the image is transferred.

Also, an image forming apparatus 101 according to this exemplary embodiment is also provided with a fixing unit 22 (an example of a fixing means) that fixes the toner image transferred to the transfer material A by the transfer unit 18.

Then, as the charging unit 12, for example, a charger is applied which is provided with a contact mode charging member 121 that charges the surface of the image support 10 and is provided with a surface layer having a configuration containing an epichlorohydrin rubber, a cleaning member 122 disposed in contact with the charging member 121, a conductive bearing unit 123 that supports both ends in the direction of each axis of the charging member 121 and cleaning member 122 such that each member rotates freely, and a power source (not shown) connected to one side of the conductive bearing unit 123.

An exemplary embodiment of each component of the image forming apparatus is explained below.

—Electrostatic Image Developer—

The electrostatic image developer has a configuration containing an electrostatic image developing toner (hereinafter referred to as "toner"). The toner may be either a one-component type developer containing a toner singly or a two-component developer prepared by mixing a toner with a carrier.

First, the toner is explained below.

As the toner, a toner is applied which contains toner particles having residual ammonium ions (toner particles containing residual ammonium ions in an amount of 0.01 ppm to 20 ppm (preferably 0.1 ppm to 10 ppm and more preferably 0.2 ppm to 2 ppm)) and silica particles containing a chlorine compound as an external additive.

The ammonium ions contained in the toner particles are contained as contaminants when a binder resin is synthesized (for example, these ammonium ions are added as a neutralizer in an emulsification operation) and when toner particles are prepared (for example, these ammonium ions are added to keep a dispersing state in water). Also, though there is the case where water containing trace ammonia is brought into contact with the kneaded product to cool the kneaded product to thereby restrain excess heating during kneading not only in the wet method but also in the kneading milling method, these ammonium ions are not completely removed but partly remain.

Here, the toner particles contain ammonium ions in a residual amount falling in the above range. In this case, examples of a method of controlling the amount of the ammonium ion in the above range include:

(1) a method in which a washing step is carried out many times in an aqueous solution having a low pH;

(2) a method in which a drying step is carried out at high temperatures for a long time;

(3) a method in which ammonia and an alkali such as sodium hydroxide other than ammonia is used; and (4) a method in which ammonium ions are removed together with other volatile components under reduced pressure after the preparation of toners.

In the case of toner particles containing no ammonium ion, and when, for example, other alkalis are used as mentioned in the above (3), the distribution of dispersion diameter of resin particles tends to be unstable, with the result that a toner containing particles having smaller grain sizes tends to be produced. Smaller grain size particles tend to be coagulated with each other, and thereby water tends to remain unremoved at the grain boundaries in the coagulated particles, and there is the case where this water causes image deletion.

The residual amount of ammonium ions is measured in the following method.

A toner (toner particles) is dispersed in water which is ultrasonically dispersed at a temperature equal to or more than the glass transition temperature or melting temperature of the resin contained in the toner to extract ammonium ions in water, and then, the toner solution was analyzed by ion chromatography to thereby find the content of ammonium ion in the toner.

Specifically, first, a 200 mL lidded flask is charged with a toner dispersion solution containing 0.5 g of the toner (toner particles) and 100 mL of a dispersion solution containing 1.0% by weight of polyvinyl alcohol in pure water and this dispersion solution is dispersed at a temperature of 80° C. which is higher than the glass transition temperature of the resin contained in the toner for 30 minutes by a ultrasonic dispersing machine (trade name: USD-4R, manufactured by AS ONE Co., Ltd., 28 kHz). Then, a filtrate obtained by suction filtration of the toner dispersion solution is analyzed by an ion chromatographic device (trade name: ICS-2000, manufactured by Nippon Dionex K.K.) to find the content of ammonium ions in the toner.

In this case, the conditions of analysis are as follows: cation separation column: (trade name: ION PAC CS 12A, manufactured by Nippon Dionex K.K.), cation guard column: (trade name: ION PAC CG12A, manufactured by Nippon Dionex K.K.), eluent: methanesulfonic acid 20 mM, flow rate: 1 mL/min, temperature: 35° C., detection method: electroconductivity method (suppressor system).

Configuration of the toner particles will be described.

The toner (toner particles) includes, for example, binder resin and a colorant, and may include a release agent, and other additives as a component of the toner, as needed.

The binder resin is not particularly limited, but examples thereof include: homopolymers formed of monomers such as styrenes (such as styrene, parachlorostyrene, or α-methylstyrene), esters having a vinyl group (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate), vinyl nitriles (such as acrylonitrile or methacrylonitrile), vinyl ethers (such as vinyl methyl ether or vinyl isobutyl ether), vinyl ketones (such as vinyl methyl ketone, vinyl ethyl ketone, or vinyl isopropenyl ketone), or polyolefins (such as ethylene, propylene, or butadiene); copolymers obtained by using a combination of two or more of these monomers; and mixtures thereof. Other examples of the binder resin include non-vinyl condensation resins such as an epoxy resin, a polyester resin, a polyurethane resin, a polyamide resin, a cellulose resin, or a polyether resin, a mixture of any one of these resins and any one of the vinyl resins, and graft polymers obtained by polymerizing the vinyl monomers under the presence of the condensation resins.

The styrene resin, the (meth)acryl resin, and the styrene-(meth)acryl copolymer resin may be obtained, for example, by known methods using styrene monomers or (meth)acrylic acid monomers singly or using a combination of styrene monomers and (meth)acrylic acid monomers. The term "(meth)acryl" means that it includes both "acryl" and "methacryl". Similarly, the term "(meth)acrylic" means that it includes both "acrylic" and "methacrylic".

The polyester resin may be obtained by synthesizing appropriate components selected from polycarboxylic acids and polyols using a known method such as an ester exchange method or a condensation-polymerization method.

When a styrene resin, a (meth)acryl resin, or a copolymer resin thereof is used as the binder resin, it is preferable that the binder resin has a weight-average molecular weight (Mw) in the range of from 20,000 to 100,000 (or from about 20,000 to about 100,000) and a number-average molecular weight (Mn) in the range of from 2,000 to 30,000 (or from about 2,000 to about 30,000). On the other hand, when a polyester resin is used as the binder resin, it is preferable that the binder resin has a weight-average molecular weight (Mw) in the range of from 5,000 to 40,000 (or from about 5,000 to about 40,000) and a number-average molecular weight (Mn) in the range of from 2,000 to 10,000 (or from about 2,000 to about 10,000).

Colorants will be described below.

Any one of the known colorants is used as the colorant without particular limitation. Examples of the colorant include carbon black such as farness black, channel black, acetylene black, or thermal black, inorganic pigments such as colcothar, Prussian blue, or titanium oxide, azo pigments such as Fast yellow, disazo yellow, pyrazolone red, chelate red, brilliant carmine, or para Brown, phthalocyanine pigments such as copper phthalocyanine or metal-free phthalocyanine, and condensed polycyclic pigments such as flavanthrone yellow, dibromoanthrone orange, perylene red, quinacridone red, or dioxazine violet.

A surface-processed colorant may be used as the colorant as needed. The colorant may be used in combination with a dispersing agent. Any one of the colorants may be used singly, or in a combination of plural species of the colorants.

Among these compounds, pigments having an azo group are preferable as a colorant.

The pigments having an azo group are pigments synthesized by an azotizing reaction in the presence of a mineral acid typified by hydrochloric acid and have a tendency that acid components remain unremoved, resulting in that ammonia in the toner is easily removed, which are preferable.

Specific examples of the pigments having an azo group include Fast Yellow, Disazo Yellow, Pyrazolone Red, Chelate Red, Brilliant Carmine and Para Brown.

The content of the colorant in the toner is preferably in the range of from 1 part by weight or about 1 part by weight to 30 parts by weight or about 30 part by weight with respect to 100 parts by weight of the binder resin.

A release agent will be described below.

Examples of the release agent include, but not limited to: hydrocarbon wax; natural wax such as carnauba wax, rice wax, or candelilla wax; synthesized or mineral and petroleum wax such as montan wax; and ester wax such as fatty acid ester or montanic acid ester.

The melting temperature of the release agent is preferably 50° C. or higher or about 50° C. or higher, and more preferably 60° C. or higher or about 60° C. or higher, in view of preservability. The melting temperature of the release agent is preferably 110° C. or lower or about 110° C. or lower, and more preferably 100° C. or lower or about 100° C. or lower, in view of offset resistance.

The content of the release agent in the toner is preferably in the range of from 1% by weight to 15% by weight or from about 1% by weight to about 15% by weight, more preferably in the range of from 2% by weight to 12% by weight or from about 2% by weight to about 12% by weight, and even more preferably in the range of from 3% by weight to 10% by weight or from about 3% by weight to about 10% by weight.

Other additives will be described below.

Examples of other internal additives include a magnetic substance, a charge control agent, and an inorganic powder.

The characteristics of the toner particles are explained.

The toner particle may have either a monolayer configuration or a configuration (so-called core-shell structure) constituted of a core part and a coating layer which covers the core part.

The volume-average particle diameter of the toner particles is, for example, in a range of from 2 μm to 15 μm, and preferably in a range of from 3 μm to 10 μm.

Specifically, in preparation of the measurement sample of the volume-average particle diameter of the toner particles, 0.5 mg to 50 mg of a sample to be measured is added to 2 mL of a 5% aqueous solution containing a surfactant, preferably sodium alkylbenzene sulfonate, as a dispersing agent, and the resultant is added to 100 mL to 150 mL of an electrolyte aqueous solution (ISOTON solution (registered trademark) manufactured by Beckman Coulter Inc.). The electrolyte containing the sample suspended therein is subjected to a dispersion treatment using an ultrasonic disperser for about 1 minute, and then the size distribution of particles is measured. The measurement of the volume-average particle diameter of the toner particles is carried out by measuring particle size distribution of particles in a range of from 2.0 μm to 60 μm using COULTER MULTISIZER II (trade name, manufactured by Beckman Coulter Inc.) with an aperture diameter of 100 μm. The number of particles to be measured is 50,000.

The obtained size distribution of the particles is accumulated to draw a cumulative volume distribution from the smallest particle diameter for divided particle size ranges (channels), and the particle diameter corresponding to 50% in the cumulative volume distribution is defined as the volume-average particle diameter D50v.

The external additive is explained below.

As the external additive, silica particles containing a chlorine compound is applied.

Examples of the silica particles containing a chlorine compound include those used for stabilizing a treating agent in the stage of, for example, hydrophobic treatment of silica particles and silica particles obtained by using a treating agent itself having a salt structure, that is, silica particles containing chlorine.

Specific examples of the chlorine compound include hydrochloric acid, chloric acid, chlorous acid, hydrochlorous acid, perchloric acid and chloroacetic acid.

Here, the chlorine compound contained in the silica particles is confirmed by XPS to determine whether or not chlorine exists.

As the external additive, other inorganic particles may be used in combination with silica particles containing chlorine compound, and examples of the inorganic particles include $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$ and $MgSO_4$.

The surface of the external additive may be subjected to a hydrophobization treatment in advance. The hydrophobization treatment is carried out by, for example, immersing the inorganic particles in a hydrophobization treating agent, or the like. The hydrophobization treating agent is not particularly limited, but examples of the hydrophobization treating agent include a silane-based coupling agent, silicone oil, a titanate-based coupling agent, an aluminum-based coupling agent, and the like. These may be used singly, or in a combination of two or more kinds thereof.

The amount of the hydrophobization treating agent is usually, for example, in a range of from 1 part by weight to 10 parts by weight or about 1 part by weight to about 10 parts by weight with respect to 100 parts by weight of the inorganic particles.

The externally added amount of the external additive is preferably, for example, in a range of from 0.5 parts by weight to 2.5 parts by weight or about 0.5 parts by weight to about 2.5 parts by weight with respect to 100 parts by weight of the toner particles.

Next, the method for preparing the toner according to the exemplary embodiment of the present invention will be described.

First, toner particles may be prepared by either a dry preparation method (for example, a kneading pulverization method), or a wet preparation method (for example, an agglomeration-unification method, a suspension polymerization method, a dissolution-suspension granulation method, a dissolution-suspension method, a dissolution-emulsification agglomeration-unification method). These preparation methods are not particularly limited, and any well known preparation method may be employed.

When the toner particles are prepared by the coagulative uniting method, for example, a dispersion solution containing binder resin particles, and, as required, a dispersion solution containing particles of a colorant and a dispersion solution containing release agent particles are prepared and these dispersion solutions are mixed to coagulate these particles, thereby producing a dispersion solution in which the coagulated particles are dispersed. In succession, the resulting dispersion solution is heated to, for example, a temperature equal to or more than the glass transition temperature of the binder resin to fuse and unite these coagulated particles, thereby obtaining toner particles.

Also, when toner particles having a core/shell structure are prepared by the coagulative uniting method, for example, a dispersion solution containing binder resin particles, and, as required, a dispersion solution containing particles of a colorant and a dispersion solution containing releasing agent particles are prepared and these dispersion solutions are mixed to coagulate these particles, thereby producing a dispersion solution in which the coagulated particles are dispersed. The dispersion solution containing binder resin particles is mixed with the above dispersion solution in which the coagulated particles are dispersed to make each particle adhere to the surfaces of the coagulated particles. In succession, the resulting dispersion solution is heated up to, for example, a temperature equal to or more than the glass transition temperature of the binder resin to fuse and unite the coagulated particles with each particle stuck to the surface thereof, thereby obtaining toner particles.

The toner according to the exemplary embodiment is prepared by, for example, adding an external additive to the obtained toner particles, and mixing them. The mixing is preferably carried out using, for example, a V-blender, a Henschel mixer, a Loedige mixer or the like. Furthermore, if necessary, coarse particles of the toner may be eliminated using a vibrating screening machine, an air screening machine or the like.

Next, the carrier will be described below. The carrier is not particularly limited, and any known carrier may be used. Examples of the carrier include a resin-coated carrier, a magnetically dispersed type carrier, a resin-dispersed type carrier, and the like.

Here, the mixture ratio (weight ratio) of the toner and the carrier (i.e., toner:carrier) in the two-component developer obtained by mixing the toner and the carrier is preferably in the range of from 1:100 to 30:100, and more preferably in the range of from 3:100 to 20:100.

—Image Support—

As the image support 10, an organic photoreceptor material is preferably used which has the so-called function separation type structure in which the charge generation layer is separated from the charge transfer layer, though a known photoreceptor material is applied without any particular limitation. Also, as the image support 10, a photoreceptor material is also preferably applied which has a surface layer including a siloxane type resin and a phenol type resin having charge transferability and a crosslinked structure.

—Exposure Unit—

As the exposure unit 14, for example, laser optical systems and LED arrays are applied.

—Charging Unit—

In the charging unit 12, the charging member 121 that charges the surface of the image support 10 and the cleaning member 122 are arranged in such a manner that the both are in contact with each other in a specified amount of bite. Both ends in the direction of each axis of the shafts of the charging member 121 and cleaning member 122 are supported by the conductive bearing unit 123 in freely rotatable manner. A power source (not shown) is connected to one side of the conductive bearing unit 123.

The following descriptions are to explain the charging member 121.

The charging member 121 is a roll member including, for example, a shaft and an elastic layer disposed on the outer peripheral surface of the shaft. The elastic layer constituting the surface layer includes an epichlorohydrin rubber.

No particular limitation is imposed on the charging member 121 as long as the outermost surface layer of the charging member 121 includes an epichlorohydrin rubber. The charging member 121 may have a configuration provided with an adhesive layer (primer layer) disposed between the elastic layer and the shaft or a configuration provided with other intermediate layers.

Also, the charging member 121 is not limited to a roll-like member and may be an endless belt-like member or a sheet-like member.

The shaft constituting the charging member 121 is a conductive bar-like member and examples of the material include metals such as iron (for example, free-cutting steel), copper, brass, stainless, aluminum and nickel. Also, examples of the shaft constituting the charging member 121 include members (for example, resins, ceramic members) of which the outside peripheral surface is plated and members (for example, resins, ceramic members) in which conductive agents are dispersed. The shaft constituting the charging member 121 may be either a hollow member (cylinder member) or non-hollow member. Here, the "conductive" means that the volume resistance is less than $10^{13}$ Ωcm.

On the other hand, the elastic layer constituting the charging member 121 has a configuration containing, for example, an epichlorohydrin rubber and, as required, other additives such as a conductive agent.

As the epichlorohydrin rubber, a polymerized rubber singly using epichlorohydrin or a copolymer rubber such as an epichlorohydrin-ethylene oxide copolymer rubber or epichlorohydrin-ethylene oxide-arylglycidyl ether copolymer rubber may be used.

Specific examples of the epichlorohydrin rubber include GECHRON 1100, GECHRON 3100, GECHRON 3101, GECHRON 3102, GECHRON 3103, GECHRON 3105 and GECHRON 3106 (trade names) which are each different in volume resistance and all manufactured by Zeon Corporation. Two or more of these products may be combined with prior to use.

Besides an epichlorohydrin rubber, other elastic materials may be combined with. However, the epichlorohydrin rubber is preferably contained in an amount of 60% by weight or more (preferably 80% by weight or more) based on all elastic materials.

Other examples of the elastic material include an isoprene rubber, butyl rubber, polyurethane, silicone rubber, fluorocarbon-rubber, styrene-butadiene rubber, butadiene rubber, nitrile rubber, ethylene propylene rubber, ethylene-propylene-diene ternary copolymer rubber (EPDM), acrylonitrile-butadiene copolymer rubber (NBR), natural rubber and blended rubbers of these rubbers.

In this regard, these elastic materials including the epichlorohydrin rubber may be either foamed or non-foamed ones.

Examples of the conductive agent include an electroconductive agent or an ionic conductive agent. Examples of the electroconductive agent include powder such as carbon black (for example, Ketjen black and Acetylene black); thermal decomposition carbon or graphite; various conductive metals or alloys (for example, aluminum, copper, nickel and stainless steel); various conductive metal oxides (for example, tin oxide, indium oxide, titanium oxide, tin oxide-antimony oxide solid solution and tin oxide-indium oxide solid solution); or an insulating substance whose surface has been subjected to conducting treatment. Examples of the ionic conductive agent include perchlorates and chlorates of oniums such as tetraethylammonium or lauryl trimethyl ammonium; and perchlorates and chlorates of alkaline metals or alkaline earth metals such as lithium or magnesium. These conductive agents may be used singly or in a combination of two or more kinds thereof.

The addition amount of the conductive agent is not particularly limited. When the above-described electroconductive agent is used, the addition amount thereof is preferably in the range of from 1 part by weight to 30 parts by weight, and more preferably in the range of from 15 parts by weight to 25 parts by weight, with respect to 100 parts by weight of the elastic material. When the above-described ionic conductive agent is used, the addition amount thereof is preferably in the range of from 0.1 parts by weight to 5.0 parts by weight, and more preferably in the range of from 0.5 parts by weight to 3.0 parts by weight, with respect to 100 parts by weight of the elastic material.

Examples of the additives that may be added in the elastic layer configuring the charging member 121 include materials that can be generally added in the elastic layer, such as a softener, a plasticizer, a curing agent, a vulcanizing agent, a vulcanization accelerator, an antioxidant, a surfactant, a coupling agent, or a filler (for example, silica or calcium carbonate).

The average film thickness of the elastic layer configuring the charging member 121 is preferably from about 1 mm to about 10 mm, and more preferably from about 2 mm to about 5 mm. The volume resistivity of the elastic layer is preferably from $10^3$ Ωcm to $10^{14}$ Ωcm.

Next, the cleaning member 122 will be described below. The cleaning member 122 is a cleaning member for cleaning the surface of the charging member 121. The cleaning member 122 may be a roll shape member. For example, the cleaning member 122 includes the shaft and an elastic layer formed on the outer peripheral surface of the shaft.

The shaft configuring the cleaning member 122 is a conductive rod-like member. Examples of the materials thereof include iron (free cutting steel or the like), copper, brass, stainless steel, aluminum and nickel. Specific examples of the shaft configuring the cleaning member 122 include a member (for example, resin members or ceramic members) whose outer peripheral surface has been plated; and a member (for example, a resin member or a ceramic member) in which a conductive agent has been dispersed. The shaft configuring the cleaning member 122 may be a hollow member (tubular member) or a non-hollow member.

It is preferable that the elastic layer configuring the cleaning member 122 has elasticity and includes a foam material having a three-dimensional porous structure, which has cavities or concave and convex portions (hereinafter referred to as "cells") inside or on the surface thereof. The elastic layer configuring the cleaning member 122 may include a foamed resin material or rubber material such as polyurethane, polyethylene, polyamide, olefin, melamine or polypropylene, NBR (acrylonitrile-butadiene copolymer rubber), EPDM (ethylene-propylene-diene copolymer rubber), natural rubber, styrene-butadiene rubber, chloroprene, silicone or nitrile.

Among these foamed resin materials or rubber materials, polyurethane that has resistance to tearing or extension is particularly preferable, in order to frictionally slide on the charging member 121 and efficiently remove a foreign substance (such as toner or an external additive), in order to prevent the surface of the charging member 121 from being scratched due to rubbing of the cleaning member 122 and in order to prevent the occurrence of tearing or breakage over the long-term.

Examples of polyurethane are not particularly limited, but include reaction products of polyol (such as polyester polyol, polyether polyester, or acrylpolyol) and isocyanate (such as 2,4-toluene diisocyanate, 2,6-toluene diisocyanate, 4,4'-diphenylmethane diisocyanate, tolidine diisocyanate, or 1,6-hexamethylene diisocyanate) and may further include a chain extender (such as 1,4-butane diol or trimethylolpropane) as a reaction component. The foaming of polyurethane is generally performed using a foaming agent such as water or azo compound (such as azodicarbonamide or azobisisobutyronitrile).

The number of cells per 25 mm of the elastic layer configuring the cleaning member 122 (number/25 mm) is preferably from 20/25 mm to 80/25 mm, more preferably from 30/25 mm to 80/25 mm, and still more preferably from 30/25 mm to 50/25 mm.

The hardness of the elastic layer configuring the cleaning member 122 is preferably from 100 N to 500 N, more preferably from 100 N to 400 N, and even more preferably from 150 N to 400 N.

Next the conductive bearing 123 will be described below. The conductive bearing 123 is a member that rotatably holds the charging member 121 together with the cleaning member 122 such that the distance between the shafts of the members is maintained. The conductive bearing 123 may be formed of any material and may have any shape, as long as the material is conductive. For example, the conductive bearing 123 may be a conductive bearing or a conductive sliding bearing.

Next the power supply will be described below. The power supply is a device that charges the charging member 121 and the cleaning member 122 to have the same polarity by applying a voltage to the conductive bearing 123. A known high-voltage power supply may be used as the power supply 124.

—Developing Unit—

The developing unit 16 may be a developing unit in which a toner image is formed by bringing a developer holding member, holding a developer layer on the surface thereof, into contact with or adjacent to the image holding member 10, and attaching a toner to a latent image on the surface of the image holding member 10. A developing method used in the developing unit 16 is preferably a known method such as a method using a two component developer. Examples of the developing method using a two component developer include a cascade development and a magnetic brush development.

—Transfer Unit—

Examples of the transfer unit 18 include a non-contact transferring unit such as corotron or scorotron, and a contact transferring unit that transfers a toner image to the transfer receiving medium A by contacting a conductive transfer roller with the image holding member 10 through the transfer receiving medium A.

—Cleaning Unit—

Examples of the cleaning unit 20 include a cleaning blade 20A that removes a toner, paper powder, contaminants, discharge products and/or the like attached to the surface of the image holding member 10 by directly contacting the cleaning blade with the surface of the image holding member 10.

Here, the cleaning blade 20A is brought into contact with the image support 10 to scrape and remove adherent substances such as toners stuck to the surface of the image support 10 by the rotation of the image support 10. At this time, a deposit of adherent substances such as a toner is deposited on the contact part (between the top of the cleaning blade 20A and the image support 10) of the cleaning blade 20A with the image support 10. A part of the adherent substances to be removed by the cleaning blade 20A is deposited since the adherent substances are sandwiched between the cleaning blade 20A and the image support 10, with the result that the effect of cleaning the surface of the image support 10 is improved by this deposit.

Then, the content of Si in the deposit is preferably designed to be higher than the content of Si in the toner. Specifically, the content of Si in the deposit is preferably two or more times higher, more preferably three or more times higher and even more preferably four or more times higher than the content of Si in the toner, with the upper limit being five or less times higher than the content of Si in the toner.

This implies that, in the toner, silica particles (silica particles containing chlorine compounds) externally added to the toner particles are made to exist in a larger amount in the deposit than in the toner.

The content of Si in the toner is the content of Si in the toner before the developing operation, that is, the content of Si in the toner contained in the developing unit 16.

Also, the content of Si in the deposit is the content of Si in the deposit formed after an image is formed.

The content of Si in the deposit and toner is found in the following manner.

The amount of Si with respect to the amount of carbon (C amount) derived from the binder resin in the toner is calculated from the data detected by surface X-ray analysis XPS. With regard to the deposit, the amount of Si with respect to the amount of carbon (C amount) contained in 1 g of adherent substances scraped from the cleaning blade is likewise calculated by surface X-ray analysis XPS.

Also, chlorine compounds (chlorine) in the deposit is also confirmed by XPS of the object.

Examples of a method of increasing the content of Si in the deposit include 1) a method in which the amount of the silica particles externally added to the toner particles is increased, 2) a method in which the grain size of the silica particles externally added to the toner particles is increased, 3) a method in which the silica particles externally added to the toner particle are treated to lessen the adhesive strength to the toner particles, 4) a method in which the adhesive strength of the silica particles externally added to each toner particle is lessened by narrowing the grain size distribution of the toner particles, and 5) a method in which the toner particles are made to have a shape closer to a sphere to thereby reduce the amount of the external silica particles falling in concave parts of the toner particles, thereby making the silica particles remain more easily on the surface of the image support 10. These methods may be used in combinations of two or more thereof.

Preferable examples of the fixing unit 22 include a heating fixing unit using a heat roller. For example, the heating fixing unit includes a fixing roller having a heater lamp for heating in its cylindrical core and, on the outer peripheral surface thereof, having a so-called releasing layer such as a heat resistant resin coating layer or a heat-resistant rubber coating layer, and a pressurizing roller or a pressurizing belt that comes into contact with the fixing roller at a specific contact pressure and has a heat resistant elastic layer formed on the outer peripheral surface of the cylindrical core or the surface of a belt-like base thereof. In a fixing process of an unfixed toner image, the transfer receiving medium A to which the unfixed toner image has been transferred is passed between the fixing roller and the pressurizing roller or belt, and the toner image is fixed by thermally melting a binding resin or additives in the toner.

—Image Formation Process (Image Formation Method)—

The following descriptions are to explain an image formation process (image formation method) using the image forming apparatus 101 according to this exemplary embodiment.

In the image forming apparatus 101 according to this exemplary embodiment, first, the image support 10 is charged by the charging member 121 of the charging unit 12 at the same time when it is rotated (for example, rotated clockwise in the drawing).

Next, the image support 10 surface-charged by the charging member 121 of the charging unit 12 is exposed by the exposure unit 14 to form an electrostatic image (latent image) on the surface of the image support 10.

Then, when the electrostatic image (latent image) formed on the surface of the image support 10 approaches the developing unit 16, a magnetic brush included of an electrostatic developer is brought into contact with the image support 10 in the developing unit 16, thereby allowing the toner to adhere to the electrostatic image (latent image) to form a toner image.

Next, when the image support 10 with the toner image formed thereon is made to further rotate, the toner image is transferred to a transfer material A by the transfer unit 16. Thus, the toner image is formed on the transfer material A.

Then, the transfer material A with the toner image formed thereon is treated by the fixing unit 22 to fix the toner image.

Here, after the toner image is transferred to the transfer material A, the image support 10 is cleaned by the cleaning blade 20A of the cleaning unit 20 to remove the toner and discharge products left on the surface. The image support 10 from which the toner and discharge products left after the transfer operation are removed in the cleaning unit 20 is neutralized in electrostatic manner by the neutralization unit 26, again charged by the charging member 121 of the charging unit 12, exposed to light by the exposure unit 14 to form an electrostatic image (latent image) to carry out the next image formation process.

In the image forming apparatus 101 according to this exemplary embodiment explained above, a toner including toner particles in which ammonium ions remain and a silica particles containing chlorine compound as an external additive is applied as the toner to be contained in the electrostatic image developer.

In the exemplary embodiment, image deletion is suppressed by applying this toner.

Here, it is considered that the ammonium ions contained in the toner causes image deletion when it is stuck to the image support 10. This mechanism is inferred as follows.

The ammonium ions stuck to the image support 10 absorbs water in air. Although this poses no problem in its early stage, when output images are increased, a further increase in ammonium ions on the image support 10 accompanies and thereby charges on the image support 10 gradually leak. Because the grain size of a toner is generally smaller than a latent image, the leakage of charges has a small influence on development. However, because this ammonium ions and water stuck to these ammonium ions are removed with difficulty, charges required for forming an electrostatic latent image are also allowed to leak resultantly. Particularly, when charges on the image support 10 is made to disappear by applying light formed by digital images to thereby form an electrostatic latent image, an image part and non-image part formed as the electrostatic latent image are distinguished from each other by the boundary between a charged part and an uncharged part. If charges easily leak, the charges defining this boundary tend to move toward the electrostatic latent image side. Because charge leakage is easily caused in the vicinity of the part where charges once leak, this leakage of charges is followed by next leakage of charges from this part, with the result that an electrostatic latent image, and in other words, an electrostatic image in a part where no charge exists is like an image more expanded than an original latent image. If this latent image is developed, the image is developed into like a flow image because a toner tends to adhere to an uncharged part.

The ammonium ions in the toner particles which are a cause of such an image deletion are introduced as a contaminant in the preparation of toner particles and a binder resin is synthesized. Although some processes for removing these ammonium ions by washing or the like have been made so far, these ammonium ions are not perfectly removed but a part of them remains at present.

It is inferred that when silica particles containing a chlorine compound are compounded as an external additive in the toner according to this exemplary embodiment, on the contrary, ammonium ions are in contact with the silica particles when these ammonium ions transfer externally from the toner particles and these ammonium ions react with a chlorine compound contained in the silica particles to form a salt, thereby inhibiting the transfer of the ammonium ions from the toner. It is also inferred that as a result, the ammonium ions are restrained from adhering to the surface of the image support 10 and therefore, image deletion is suppressed.

Also, in this exemplary embodiment, image deletion is suppressed by applying this toner in the image forming apparatus 101 provided with the contact mode charging member 121 provided with a surface layer included of an epichlorohydrin rubber.

Here, when the contact mode charging member 121 provided with a surface layer included of an epichlorohydrin rubber is applied, the mechanism of generation of image deletion is considered as follows.

If ammonium ions are contained in the toner particles in the toner in the image forming apparatus 101 provided with the contact mode charging member 121 provided with a surface layer included of an epichlorohydrin rubber, these ammonium ions are transferred out of the toner particles (toner) and adhere to the surface of the image support 10 promoted by water on the surface of the image support 10. It is inferred that the stuck ammonium ions slip through the cleaning blade 20A that cleans the surface of the image support 10 and adhere to the surface of the charging member 121. It is also inferred that the ammonium ions stuck to the surface of the charging member 121 react with residual chlorine of the epichlorohydrin rubber constituting the surface layer of the charging member 121 to form a salt.

It is inferred that this salt absorbs water in air and drops the amount of discharge from the surface of the charging member 121. It is also considered that even if the amount of the ammonium ions stuck to the surface of the image support 10 is trace, the amount of the ammonium ions which reach the surface of the charging member 121 is accumulated with time and these ammonium ions react with residual chlorine of the epichlorohydrin rubber constituting the surface layer of the charging member 121, leading to increase in this salt. As a result, this increase in the salt is considered to drop the discharge amount of the surface of the charging member 121, causing charge inferior, leading to significant generation of image deletion based on the flow of a latent image.

It is inferred that image deletion is significantly generated in the circumstance where water is easily stuck to the surface of the image support 10, that is, in the circumstance where dew condensation occurs on the surface of the image support 10, for example, under a high-temperature and high-humidity (for example, ambient temperature: 30° C., humidity: 85%) environment and particularly, in the case where the circumstance is changed from a low-temperature and low-humidity (for example, ambient temperature: 15° C., humidity: 30%) environment to a high-temperature environment.

It is inferred that on the other hand, when the silica particles containing a chlorine compound are contained as an external additive in the toner according to this exemplary embodiment, the ammonium ions are brought into contact with the silica particles when the ammonium ions are moved out of the toner particles, and react with a chlorine compound contained in the silica particles to form a salt to thereby restrain the ammonium ions from moving out of the toner. It is inferred that as a result, the ammonium ions adhere to the surface of the image support to thereby restrain the ammonium ions from reaching the surface of the charging member 121.

It is therefore considered that in this embodiment, image deletion is suppressed in the image forming apparatus 101 provided with the contact mode charging member 121 having a surface layer included of an epichlorohydrin rubber by applying the above toner.

Also, in this exemplary embodiment, the toner particles of the above toner are made to contain a pigment having an azo group. When the toner particles of the above toner are made to contain a pigment having an azo group, image deletion is prevented more efficiently.

The pigment having an azo group is a pigment synthesized by an azotizing reaction in the presence of a mineral acid typified by hydrochloric acid as mentioned above, and therefore, the mineral acid (for example, hydrochloric acid) remains in the pigment molecule even after the synthesis. Therefore, it is inferred that when the pigment having an azo group is brought into contact with the ammonium ions left in the toner particles, these ammonium ions react with the mineral acid (for example, hydrochloric acid) left in the pigment to form a salt. For this, it is inferred that the ammonium ions are restrained from moving out of the toner particles themselves.

It is therefore considered that, when the toner particles are made to contain a pigment having an azo group, image deletion is prevented more efficiently.

Also, in this exemplary embodiment, the content of Si in a deposit accumulated at the contact part between the cleaning blade 20A and the image support 10 is designed to be larger than that in the toner.

When the content of Si in a deposit is designed to be larger than that in the toner, image deletion is suppressed more efficiently.

The silica particles (silica particles containing a chlorine compound) used as an external additive contained in the toner are scraped together with the toner particles by the cleaning blade 20A and contained in the deposit accumulated at the contact part between the cleaning blade 20A and the image support 10. It is inferred that because the silica particles in the deposit have a high hardness, they are scarcely collapsed by the pressure (pressure of the cleaning blade 20A against the image support 10) of the cleaning blade 20A.

Then, it is inferred that the silica particles are supplied between the cleaning blade 20A and the image support 10 such that the amount of the silica particles (Si content) contained in the deposit is larger than the amount of toner particles (Si content) contained in the toner, to thereby increase the amount of the silica particles in the deposit, bringing about increased cleaning effect, so that the ammonium ions stuck to the image support 10 are easily removed. It is also inferred that because the ammonium ions are brought into contact with the silica particles in the deposit, the ammonium ions react with a chlorine compound contained in the silica particles to form a salt.

This ensures that even if the ammonium ions are transferred to the outside from the toner and adhere to the surface of the image support 10, the ammonium ions are removed by the deposit accumulated at the contact part between the cleaning blade 20A and the image support 10 and therefore scarcely remain on the surface of the image support 10.

In addition, the ammonium ions stuck to the surface of the image support 10 are restrained from slipping through the cleaning blade 20A, with the result that the ammonium ions are transferred from the toner to the outside and are restrained from reaching the surface of the charging member 121 even if they are stuck to the surface of the image support 10.

Therefore, it is inferred that when the content of Si in the deposit is designed to be larger than the content of Si in the toner, image deletion is prevented more efficiently.

Also, this exemplary embodiment is provided with a cleaning member 122 that is brought into contact with the surface of the charging member 121 to clean the surface of the charging member 121.

When the cleaning member 122 is provided, image deletion is suppressed more efficiently in the image forming apparatus 101 provided with the contact mode charging member 121 having a surface layer included of an epichlorohydrin rubber.

Even if the ammonium ions stuck to the surface of the image support 10 slip through the cleaning blade 20A and reach the surface of the charging member 121, these ammonium ions are easily removed by the cleaning member 122 that cleans the surface of the charging member 121. It is thereby suppressed an occurrence of such a phenomenon that the ammonium ions react with residual chlorine and the like of the epichlorohydrin rubber constituting the surface layer of the charging member 121 to form a salt.

Accordingly, it is considered that image deletion is prevented more efficiently in the image forming apparatus 101 provided with the contact mode charging member 121 having a surface layer included of an epichlorohydrin rubber by providing the cleaning member 122.

The configuration of the image forming apparatus 101 according to the present exemplary embodiment is not limited to the above-described configuration. For example, the image forming apparatus 101 according to the present exemplary embodiment may be an intermediate transfer type image forming apparatus using an intermediate transfer medium or a tandem-type image forming apparatus in which image forming units that form toner images of each color are arranged in parallel.

As shown in FIG. 6, the image forming apparatus 101 according to the present exemplary embodiment may be equipped with a process cartridge 102 formed as a cartridge and configured such that the image holding member 10, the charging unit 12, a developing unit 16, and a cleaning unit 20 are integrally combined and held by a housing 24 having an opening 24A for exposure and a mounting rail 24B. The process cartridge 102 is attachable to and detachable from the image forming apparatus 101 shown in FIG. 5.

The process cartridge 102 is not limited to the above configuration, and may be a process cartridge which is equipped with other units such as the image holding member 10, the exposure unit 14, the transfer unit 18, the cleaning unit 20, and/or the like as necessary, as long as it is equipped with the developing unit 16.

EXAMPLES

Hereinafter, the invention is described in detail with reference to Examples, but the invention is not limited to these examples. In addition, "parts" and "%" are based on weight unless otherwise specified.

(Synthesis of a Polyester Resin)

—Synthesis of a Polyester Resin (1)—

A two-neck flask which was heated and dried is charged with 80 mol parts of a polyoxypropylene (2,2)-2,2-bis(4-hydroxyphenyl)propane, 10 mol parts of ethylene glycol, 10 mol parts of cyclohexanediol, 80 mol parts of terephthalic acid, 10 mol parts of isophthalic acid and 10 mol parts of n-dodecenylsuccinic acid as raw materials and dibutyltin oxide as a catalyst. Nitrogen gas is introduced into the container to keep the inside of the container in an inert gas atmosphere and the temperature of the mixture is raised. Then, the mixture is made to undergo a co-condensation polymerization reaction at 150 to 230° C. for about 12 hrs and then, the pressure of the mixture is gradually dropped at a temperature of 210 to 250° C. to synthesize a polyester resin (1).

The weight average molecular weight (Mw) of the obtained polyester resin (1) is 17200. Also, the acid value of the polyester resin (1) is 12.4 mg KOH/g.

Further, the glass transition temperature of the polyester resin (1) is measured by a differential scanning calorimeter (DSC) to determine it by analysis according to JIS standard (see JIS K-7121).

As a result, a clear peak is not appeared but a stepwise endothermic calorimetric change is observed. The glass transition temperature (Tg) at the middle point of the stepwise endothermic calorimetric change is 59° C.

(Preparation of a Polyester Resin Dispersion Solution)

—Preparation of a Polyester Resin Dispersion Solution (A1)—

| | |
|---|---|
| Polyester resin (1) | 100 parts by weight |
| Ethyl acetate | 70 parts by weight |
| Isopropyl alcohol | 15 parts by weight |

A mixture solvent of the above ethyl acetate and isopropyl alcohol is poured into a 5 L separable flask, to which is then gradually added the above resin and the mixture is stirred by a three-one motor to dissolve the resin, thereby obtaining an oil phase.

An aqueous 10% by weight ammonia solution is gradually added dropwise to this stirred oil phase in a total amount of 3.5 parts by weight by a dropper and 230 parts by weight of ion exchanged water is further added dropwise gradually at a rate of 10 mL/min to undergo phase inversion emulsification, followed by performing a solvent removal operation under reduced pressure by an evaporator to obtain a "polyester resin dispersion solution (A1)" containing a "polyester resin (1)". The volume average particle diameter of resin particles dispersed in this dispersion solution is 182 nm. In this case, the resin particle concentration of this dispersion solution is adjusted to 20% by weight by adding ion exchanged water.

—Preparation of Polyester Resin Dispersion Solutions (A2) to (A13)—

Each polyester resin dispersion solution is obtained in substantially the same manner as that in the preparation of the polyester resin dispersion solution (A1) except that the total amount of the aqueous 10% by weight ammonia solution (written as "Dripped $NH_4OH$" in Table 1) to be added dropwise to the oil phase is changed according to those shown in Table 1 and an aqueous 0.01 N sodium hydroxide solution is gradually added dropwise to the obtained polyester resin dispersion solution by a dropper in a total amount according to those shown in Table 1 (written as "Dripped NaOH" in Table 1).

TABLE 1

| Polyester Resin Dispersion Solution No. | Dripped $NH_4OH$ (parts by weight) | Dripped NaOH (parts by weight) |
|---|---|---|
| A1 | 3.5 | 0 |
| A2 | 2.9 | 0.1 |
| A3 | 2.5 | 0.5 |
| A4 | 2.3 | 0.7 |
| A5 | 1.8 | 1.2 |
| A6 | 1.7 | 1.3 |
| A7 | 1.5 | 1.5 |
| A8 | 1.3 | 1.7 |
| A9 | 1.1 | 1.9 |
| A10 | 1.0 | 2.0 |
| A11 | 0.8 | 2.2 |
| A12 | 0.3 | 2.7 |
| A13 | 0 | 3.0 |

(Preparation of a Colorant Dispersion Solution)

—Preparation of a Colorant Dispersion Solution (B1)—

| | |
|---|---|
| Cyan pigment (trade name: Pigment Blue 15:3 (copper phthalocyanine), manufactured by Dainichiseika Color & Chemicals Mfg. Co., Ltd.) | 1000 parts by weight |
| Anionic surfactant (trade name: NEOGEN R, manufactured by Dai-ichi Kogyo Seiyaku Co., Ltd.) | 15 parts by weight |
| Ion exchanged water | 9000 parts by weight |

The above components are mixed to dissolve and then dispersed by using a high-pressure impact type dispersing machine (trade name: ALTI-MIZER HJP30006, manufactured by Sugino Machine Limited.) for about 1 hr to prepare a colorant dispersion solution in which a colorant (pigment) is dispersed. The colorant (pigment) particles in the colorant dispersion solution have a volume average particle diameter of 0.16 μm and a solid concentration of 20%. This dispersion solution is centrifuged (10000 rpm, 60 min) and the small amount of supernatant is taken out and dried. The dried product is subjected to elemental analysis, to confirm that no chlorine is present.

—Colorant Dispersion Solutions (B2) to (B5)—

Each colorant dispersion solution was obtained in substantially the same manner as that in the preparation of the colorant dispersion solution (B1) except that the type of colorant (pigment) was changed according to Table 2.

TABLE 2

| Colorant Dispersion Solution No. | Colorant (Pigment) | Color |
|---|---|---|
| B1 | B15:3 (Phthalocyanine) | Cyan |
| B2 | Y17 (Azo) | Yellow |
| B3 | Y110 (Isoindolinone) | Yellow |
| B4 | R122 (Quinacridone) | Magenta |
| B5 | R57 (Azo) | Magenta |

In Table 2, the details of the colorants (pigments) are as follows.

B15:3 = Cyan pigment (trade name: Pigment Blue 15:3, (copper phthalocyanine) manufactured by Dainichiseika Color & Chemicals Mfg. Co., Ltd.)
Y17 = Yellow pigment (trade name: SEIKAFAST YELLOW 2054 (Disazo Yellow: pigment having an azo group), manufactured by Dainichiseika Color & Chemicals Mfg. Co., Ltd.)
Y110 = Yellow pigment (trade name: CROMOPHTAL YELLOW 2RLP (isoindolinone), manufactured by BASF Japan Ltd.)
R122 = Magenta pigment (trade name: CHROMOFINE MAGENTA 6887 (quinacridone), manufactured by Dainichiseika Color & Chemicals Mfg. Co., Ltd.)
R57:1 = Magenta pigment (trade name: SEIKAFAST CARMINE 1476T-7 (pigment having an azo group), manufactured by Dainichiseika Color & Chemicals Mfg. Co., Ltd.)

The same method as that used for the colorant dispersion solution (B1) is used to confirm whether or not chorine is present in the colorant dispersion solutions (B2) to (B5) to find that chlorine is detected from the supernatant of each of the colorant dispersion solutions (B2) and (B5).

(Preparation of a Releasing Agent Dispersion Solution)

—Preparation of a Releasing Agent Dispersion Solution (C1)—

| | |
|---|---|
| Paraffin wax (trade name: HNP-9, manufactured by Nippon Seiro Co., Ltd., melting temperature: 75° C.) | 50 parts by weight |
| Anionic surfactant (trade name: NEOGEN RK, manufactured by Dai-ichi Kogyo Seiyaku Co., Ltd.) | 0.5 parts by weight |
| Ion exchanged water | 200 parts by weight |

The above components are mixed, and the mixture is heated to 95° C. and dispersed by a homogenizer (trade name: ULTRA-TURRAX T50, manufactured by IKA Co., Ltd.). Then, the mixture is dispersed by Manton Gaulin High-pressure Homogenizer (trade name, Gaulin Co., Lt.), to prepare a releasing agent dispersion solution (solid concentration: 20%) in which the releasing agent is dispersed. The volume average particle diameter of the releasing agent particles is 0.23 μm.

(Preparation of Toner Particles)

—Preparation of Toner Particles (1)—

| | |
|---|---|
| Polyester resin dispersion solution (A1) | 267 parts by weight |
| Colorant dispersion solution (B2) | 25 parts by weight |
| Releasing agent dispersion solution (C1) | 40 parts by weight |
| Anionic surfactant (Teyca Power) | 2.0 parts by weight |

The above raw materials are placed in a 2 L cylinder stainless container and are mixed by dispersing these components by a homogenizer (trade name: ULTRA-TURRAX T50, manufactured by IKA Co., Ltd.) for 10 minutes at 4000 rpm with applying shearing force. Then, 1.75 parts by weight of an aqueous 10% nitric acid solution of aluminum polychloride is gradually added dropwise as a coagulating agent and dispersed by a homogenizer at 5000 rpm for 15 minutes to mix thereby forming a raw material dispersion solution.

Thereafter, the raw material dispersion solution is poured into a polymerization kettle equipped with a stirrer and a temperature gauge. The mixture is started heating by a mantle heater to promote the growth of coagulated particles at 42° C. At this time, the raw material dispersion solution is adjusted to pH range of from 3.2 to 3.8 by using 0.3 N nitric acid or an aqueous 1 N sodium hydroxide solution. The raw material dispersion solution is kept in the above pH range and allowed to stand for 2 hrs to form coagulated particles. The volume average particle diameter of the coagulated particles is 5.4 μm.

Next, 100 parts by weight of the polyester resin dispersion solution (A1) is supplemented to the raw material dispersion solution to stick the resin particles of the polyester resin (1) to the surface of the above coagulated particles. Moreover, the raw material dispersion solution is heated to 44° C. to form uniform coagulated particles while confirming the size and form of these particles by using an optical microscope and a MULTISIZER II (trade name, manufactured by Beckman Coulter Inc.). Then, the raw material dispersion solution is adjusted to pH 7.5 by adding an aqueous NaOH solution dropwise and is then heated up to 95° C. to unite coagulated particles. Thereafter, the raw material dispersion solution is allowed to stand for 3 hrs to unite the coagulated particles. After an optical microscope is used to confirm that the coagulated particles are united, the raw material dispersion solution is cooled at a temperature descending rate of 1.0° C./min.

Toner particles are formed in the obtained raw material dispersion solution.

Next, the raw material dispersion solution is subjected to filtration and the toner particles obtained after solid-liquid separation are dispersed in 30° C. ion exchanged water having an amount 20 times the volume of the solid of the toner particles to wash.

Then, this water-washing is repeated 10 times and then, the resulting toner particles are dried and classified by a cyclone collection using a loop type air flow type drier, to obtain toner particles (1).

—Toner Particles (2) to (17)—

Each toner particle is obtained in substantially the same manner as that in the preparation of the toner particles (1) except that the polyester resin dispersion solution and colorant dispersion solution are altered to those shown in Table 3.

TABLE 3

| Toner Particle No. | Polyester Resin Dispersion Solution No. | Colorant Dispersion Solution No. | Ammonium Ion Content in Toner (ppm) |
|---|---|---|---|
| 1 | A1 | B2 | 28 |
| 2 | A2 | B2 | 21 |
| 3 | A3 | B2 | 18 |
| 4 | A4 | B2 | 13 |
| 5 | A5 | B2 | 9.3 |
| 6 | A6 | B2 | 6.3 |
| 7 | A7 | B2 | 5.2 |
| 8 | A8 | B2 | 4.1 |
| 9 | A9 | B2 | 2.1 |
| 10 | A10 | B2 | 1.8 |
| 11 | A11 | B2 | 1.1 |
| 12 | A12 | B2 | 0.5 |
| 13 | A13 | B2 | 0 |
| 14 | A12 | B5 | 0.5 |
| 15 | A12 | B4 | 0.5 |

TABLE 3-continued

| Toner Particle No. | Polyester Resin Dispersion Solution No. | Colorant Dispersion Solution No. | Ammonium Ion Content in Toner (ppm) |
|---|---|---|---|
| 16 | A12 | B3 | 0.5 |
| 17 | A12 | B1 | 0.5 |

[Preparation of a Toner]

—Preparation of a Toner (1)—

1 part by weight of the following silica particles (D1) is added as an external additive to 100 parts by weight of the toner particles (1), and these components are mixed by a Henschel mixer (top peripheral speed: 30 msec, for 1 min). 0.5 parts by weight of silica particles (D1) is added to the mixture, which is then mixed at a top peripheral speed of 15 msec for 2 min. Then, 0.5 parts by weight of silica particles (D1) is further added to the mixture, which is then mixed at a peripheral speed of 22 msec for 3 min to obtain a toner (1). The content of ammonium ions contained in the obtained toner (toner particles) is shown in Table 3.

The ratio of the content of Si/C in the obtained toner is shown as the content of Si in the toner in Table 5.

—Preparation of toners (2) to (17)—

Each toner is prepared in substantially the same manner as that in the preparation of the toner (1) except that the toner particles and external additive are altered to those shown in Table 4.

The ratio of the content of Si/C in the obtained toner is shown as the content of Si in the toner in Table 5.

—Toner (18) (Kneading Milling Method)—

100 parts by weight of a polyester resin (1), 4 parts by weight of Y17=Yellow pigment (trade name: SEIKAFAST YELLOW 2400 (B) (Disazo Yellow), manufactured by Dainichiseika Color & Chemicals Mfg. Co., Ltd.), and 4 parts by weight of a releasing agent paraffin wax (trade name: HNP-9, manufactured by Nippon Seiro Co., Ltd., melting temperature: 75° C.) are melt-kneaded by a Bambury-type kneader. The mixture is cooled and then treated by coarse milling. Then, the milled coarse particles are further pulverized by a jet type pulverizing mill and then, 2 parts by weight of ammonium hydroxide is added to the pulverized particles. The obtained particles are classified by an Elbow-Jet classifier (manufactured by MATSUBO Corporation) to prepare toner particles (18) having an average particle diameter of 7.0 μm. Then, an external additive is added to these toner particles in substantially the same manner as that in the preparation of the toner (1) to obtain a toner (18). The content of ammonium ions in the toner (18) is 30 ppm.

—Toner (19)—

100 parts by weight of the toner particles (12) and 2 parts by weight of silica particles (D1) are added and mixed by a Henschel mixer (top peripheral speed: 30 m/sec, for 20 min) to obtain a toner (19).

—Toner (20)—

100 parts by weight of the toner particles (12) and 0.5 parts by weight of silica particles (D1) are added and mixed by a Henschel mixer (top peripheral speed: 30 in/sec, for 1 min). 0.5 parts by weight of silica particles (D1) is added to the mixture, which is then mixed at a top peripheral speed of 15 msec for 2 min to obtain a toner (20).

—Toner (21)—

Toner (21) is prepared in substantially the same manner as that in the preparation of toner (1) except that 100 parts by weight of the toner particles (12) and silica particles (D2) are used instead of 100 parts by weight of the toner particles (1) and silica particles (D1) in the preparation of toner (1).

—Toner (22)—

Toner (22) is prepared in substantially the same manner as that in the preparation of toner (1) except that 100 parts by weight of the toner particles (12) and silica particles (D3) are used instead of 100 parts by weight of the toner particles (1) and silica particles (D1) in the preparation of toner (1).

—Toner (23)—

Toner (23) is prepared in substantially the same manner as that in the preparation of toner (1) except that 100 parts by weight of the toner particles (12) and silica particles (D4) are used instead of 100 parts by weight of the toner particles (1) and silica particles (D1) in the preparation of toner (1).

—Toner (24)—

Toner (24) is prepared in substantially the same manner as that in the preparation of toner (1) except that 100 parts by weight of the toner particles (3) and silica particles (D4) are used instead of 100 parts by weight of the toner particles (1) and silica particles (D1) in the preparation of toner (1).

—Toner (25)—

15 parts by weight of the toner particles (12) and 1.5 parts by weight of the silica particles (D1) are added and mixed by a Henschel mixer (top peripheral speed: 22 msec, for 1 min). 85 parts by weight of the toner particles (12) and 0.5 parts by weight of silica particles (D1) are added to the mixture, which is then mixed at a top peripheral speed of 30 msec for 10 min to obtain a toner (25).

—Toner (26)—

15 parts by weight of the toner particles (12) and 1.0 part by weight of the silica particles (D1) are added and mixed by a Henschel mixer (top peripheral speed: 22 m/sec, for 1 min). 85 parts by weight of the toner particles (12) and 1.0 part by weight of silica particles (D1) are added to the mixture, which is then mixed at a top peripheral speed of 30 m/sec for 10 min to obtain a toner (26).

—Toner (27)—

15 parts by weight of the toner particles (12) and 1.0 part by weight of the silica particles (D1) are added and mixed by a Henschel mixer (top peripheral speed: 22 msec, for 1 min). 85 parts by weight of the toner particles (12) and 1.0 part by weight of silica particles (D1) are added to the mixture, which is then mixed at a top peripheral speed of 30 msec for 5 min to obtain a toner (27).

—Toner (28)—

10 parts by weight of the toner particles (12) and 0.5 parts by weight of the silica particles (D1) are added and mixed by a Henschel mixer (top peripheral speed: 15 m/sec, for 1 min). 90 parts by weight of the toner particles (12) and 1.5 parts by weight of silica particles (D1) are added to the mixture, which is then mixed at a top peripheral speed of 22 msec for 5 min to obtain a toner (28).

—Toner (29)—

Toner (29) is prepared in substantially the same manner as that in the preparation of toner (28) except that the toner particles (9) are used instead of the toner particles (12) in the preparation of toner (28).

—Toner (30)—

Toner (30) is prepared in substantially the same manner as that in the preparation of toner (27) except that the toner particles (5) are used instead of the toner particles (12) in the preparation of toner (27).

—Toner (31)—

Toner (31) is prepared in substantially the same manner as that in the preparation of toner (25) except that the toner particles (5) are used instead of the toner particles (12) in the preparation of toner (25).

—Toner (32)—

Toner (32) is prepared in substantially the same manner as that in the preparation of toner (27) except that the toner particles (4) are used instead of the toner particles (12) in the preparation of toner (27).

—Toner (33)—

Toner (33) is prepared in substantially the same manner as that in the preparation of toner (25) except that the toner particles (3) are used instead of the toner particles (12) in the preparation of toner (25).

—Toner (34)—

Toner (34) is prepared in substantially the same manner as that in the preparation of toner (19) except that the toner particles (3) are used instead of the toner particles (12) in the preparation of toner (19).

—Toner (35)—

Toner (35) is prepared in substantially the same manner as that in the preparation of toner (25) except that the toner particles (2) are used instead of the toner particles (12) in the preparation of toner (25).

TABLE 4

| Toner No. | Toner Particles No. | External Additive No. | Content Ratio Si/C in Toner |
|---|---|---|---|
| 1 | 1 | D1 | 0.021 |
| 2 | 2 | D1 | 0.021 |
| 3 | 3 | D1 | 0.021 |
| 4 | 4 | D1 | 0.021 |
| 5 | 5 | D1 | 0.021 |
| 6 | 6 | D1 | 0.021 |
| 7 | 7 | D1 | 0.021 |
| 8 | 8 | D1 | 0.021 |
| 9 | 9 | D1 | 0.021 |
| 10 | 10 | D1 | 0.021 |
| 11 | 11 | D1 | 0.021 |
| 12 | 12 | D1 | 0.021 |
| 13 | 13 | D1 | 0.021 |
| 14 | 14 | D1 | 0.021 |
| 15 | 15 | D1 | 0.021 |
| 16 | 16 | D1 | 0.021 |
| 17 | 17 | D1 | 0.021 |
| 18 | 18 | D1 | 0.021 |
| 19 | 12 | D1 | 0.021 |
| 20 | 12 | D1 | 0.021 |
| 21 | 12 | D2 | 0.021 |
| 22 | 12 | D3 | 0.021 |
| 23 | 12 | D4 | 0.021 |
| 24 | 3 | D4 | 0.021 |
| 25 | 12 | D1 | 0.021 |
| 26 | 12 | D1 | 0.021 |
| 27 | 12 | D1 | 0.021 |
| 28 | 12 | D1 | 0.021 |
| 29 | 9 | D1 | 0.021 |
| 30 | 5 | D1 | 0.021 |
| 31 | 5 | D1 | 0.021 |
| 32 | 4 | D1 | 0.021 |
| 33 | 3 | D1 | 0.021 |
| 34 | 3 | D1 | 0.021 |
| 35 | 2 | D1 | 0.021 |

In Table 4, the details of the external additives are as follows.

Silica particles (D1): silica particles containing a chlorine compound.

The silica particles (D1) are obtained in the following manner. 100 parts by weight of AEROSIL 130 (trade name, manufactured by NIPPON AEROSIL CO., LTD., 16 nm) is added in a mixture solution prepared by adding 2 parts by weight of hexamethyl disilazane (trade name: SZ6079, manufactured by Dow Corning Toray Silicone Co., Ltd.) in a mixture solution of 30 parts by weight of hydrochloric acid having a concentration of 0.2 mol/L and 30 parts by weight of methanol. The mixture is allowed to stand at 50° C. with stirring and then, subjected to an evaporator to remove water. After water is removed, the mixture is heated at 90° C. for 1 hr and further crushed to obtain silica particles (D1).

The obtained silica particles are measured by XPS, to find that the obtained silica particles (D1) contain chlorine in an amount of 0.08% based on all elements.

Silica particles (D2): silica particles containing no chlorine compound.

Silica particles (D2) are obtained in the following manner. The silica particles (D2) are prepared in substantially the same manner as that in the preparation of Silica particles (D1) except that AEROSIL 130 (trade name, manufactured by NIPPON AEROSIL CO., LTD., 16 nm) is treated with a solution of 60 parts by weight of methanol and methyltrimethoxysilane (trade name: SZ6070, manufactured by Dow Corning Toray Silicone Co., Ltd.) instead of hexamethyl disilazane (trade name: SZ6079, manufactured by Dow Corning Toray Silicone Co., Ltd.) in the preparation of Silica particles (D1).

The obtained silica particles are measured by XPS, to find that the obtained silica particles (D2) contain no chlorine.

—Silica Particles (D3)—

Silica particles (D3) are prepared in substantially the same manner as that in the preparation of Silica particles (D2) except that N-β-(N-vinylbenzylaminoethyl)-γ-aminopropyltrimethoxysilane hydrochloric acid salt (SZ6032; trade name, manufactured by Dow Corning Toray Silicone Co., Ltd.) is used instead of methyltrimethoxysilane in the preparation of Silica particles (D2).

The obtained silica particles are measured by XPS, to find that the obtained silica particles (D3) contain chlorine in an amount of 0.02% based on all elements.

Silica particles (D4): silica particles containing no chlorine compound.

Silica particles (D4) are obtained in the following manner. The silica particles (D4) are prepared in substantially the same manner as that in the preparation of Silica particles (D1) except that AEROSIL 380 (trade name, manufactured by NIPPON AEROSIL CO., LTD., 7 nm) is used instead of AEROSIL 130 (trade name, manufactured by NIPPON AEROSIL CO., LTD., 16 nm) in the preparation of Silica particles (D1). The obtained silica particles are measured by XPS, to find that the obtained silica particles (D4) contain chloride in an amount of 0.8% based on all elements.

Examples 1 to 33, Comparative Example 1

Preparation of a Developer 8 parts by weight of the obtained toner and 92 parts by weight of the following carrier are poured into a 2 L V-blender according to the formulation shown in Table 5. These components are mixed and stirred for 20 minutes and then screened through a mesh having a hole diameter of 212 μm to manufacture each developer.

—Preparation of a Carrier—

| | |
|---|---|
| Ferrite particles (average particle diameter: 35 μm) | 100 parts by weight |
| Toluene | 14 parts by weight |
| Methylmethacrylate-perfluoro-octylethylmethacrylate copolymer ((copolymerization ratio: 8:2), Mw: 76000) | 1.6 parts by weight |

These components are dispersed by a sand mill and a mixture is further stirred for 10 min by a stirrer to prepare a coating layer-forming solution, Then, the coating layer-forming solution and ferrite particles (45 μm) are poured into a vacuum deaeration type kneader. The mixture is stirred at 60° C. for 30 min and then toluene is distilled under reduced pressure to form a resin coating layer, thereby obtaining a carrier.

(Evaluation 1)

Using a remodeled machine (so remodeled that it can output as long as a developer is contained in at least one developing unit) of Apeos Port-II C4300 (trade name, manufactured by Fuji Xerox Co., Ltd.), in which the obtained developer is put in the developing unit and a toner of the same type as that of the obtained developer is put in a toner cartridge, a solid image is output continuously on 1000 sheets of paper (C2r paper, 70 g/cm$^2$) in a toner image density of 3 g/m$^2$ in an environment of an ambient temperature of 15° C. and a humidity of 30%.

After that, the above-mentioned remodeled machine is allowed to stand in an environment of an ambient temperature of 30° C. and a humidity of 85% for 24 hrs. Then, using the remodeled machine allowed to stand, an image with an alphabetical character "A" is output by using the test chart No. 1-R of the Society of Electrophotography of Japan. Image deletion of the part of an alphabetical character "A" is visually evaluated (image deletion evaluation A).

The evaluation criteria are shown below.

G5: Image deletion cannot be confirmed even in the case of a minimum character "A".

G4: Minimum character "A" can be read though image deletion occurs.

G3: Though image deletion occurs and therefore, a minimum character "A" cannot be read, a next character "A" larger than the above minimum character can be read.

G2: Though image deletion occurs and the next character "A" cannot be read, a third character "A" larger than the above next character "A" can be read.

G1: Even the third character "A" cannot be read.

It is to be noted that G2 is the lowest allowable level.

Also, an evaluation B of image deletion is made in which the print output is suspended every 1000-sheet printing and allowed to stand for 30 min (in the same environment as that in the above evaluation A) and this operation is repeated, wherein a final sheet of paper in each 1000-sheet printing is evaluated in substantially the same manner as that in the evaluation A. The evaluation criteria are as shown above.

Also, a deposit accumulated at the contact part between the cleaning blade and the image support (photosensitive material) is collected when a solid image is printed on 1000 sheets of paper in a toner image density of 3 g/m$^2$ in an environment of an ambient temperature of 15° C. and a humidity of 30%, to measure the ratio (content ratio of Si/C) to determine the content of Si in the deposit.

The ratio (deposit/toner) of the ratio of Si/C in the deposit to the ratio of Si/C in the toner is also shown.

The details of the charge member (charge roll) and cleaning member for charge member (charge member cleaning roll) disposed in the remodeled machine of Apeos Port-II C4300 manufactured by Fuji Xerox Co., Ltd. are as follows.

Preparation of Charging Roller (Charging Member)

To 100 parts of an elastic material (epichlorohydrin-ethylene oxide-allyl glycidyl ether copolymer rubber), 15 parts of a conductive agent (carbon black; trade name: ASAHI THERMAL, manufactured by Asahi Carbon Co., Ltd.), 1 part of a vulcanizing agent (sulfur, 200 mesh, manufactured by Tsurumi Chemical Industry Co., Ltd.), and 2.0 parts of a vulcanization accelerator (trade name: NOCCELER DM, manufactured by Ouchi Shinko Chemical Industrial Co. Ltd.) are added. The mixture is kneaded using an open-roll kneader. Thereafter, using the resultant, a 7 mm-thick elastic layer is formed on the outer peripheral surface of a shaft (conductive support) formed of SUS303 and having a diameter of 8 mm, via an adhesive layer with a press-molding machine, thereby obtaining a roll having a diameter of 15 mm. Subsequently, the roll is polished, thereby obtaining a charging roll (charging member) having a diameter of 14 mm and having a 6 mm-thick elastic layer.

—Cleaning Member for Charge Member; Charge Member Cleaning Roll—

A 5-mm-ϕ hole is opened in the surface of a square bar of foam urethane (trade name: EPM-70, manufactured by INOAC Corporation) by a drill and a shaft which has an outside diameter of 6 mm and is coated with an adhesive (using a shaft having an outside diameter 6-mm-ϕ and whole length of 337 mm, and bearing part having an outside diameter 4-mm-ϕ and a length of 6 mm, effective length of the foam urethane is 320 mm) is inserted into the square bar, followed by polishing, to manufacture a foam roll having an outside diameter of 10 mm, thereby obtaining a cleaning roll for charge member.

(Evaluation 2)

A toner sample is evaluated in substantially the same manner as that in the evaluation 1 except that the cleaning roll for charge member is excluded from the used remodeled machine of Apeos Port-II C4300 (trade name, manufactured by Fuji Xerox Co., Ltd.).

The above results of evaluation are shown in Table 5. It is to be noted that in the evaluation 2, only evaluation B of image deletion is shown.

TABLE 5

| | | Evaluation 1 | | | |
|---|---|---|---|---|---|
| | Toner No. | Content Ratio Si/C in Deposit at Cleaning Blade (Ratio of Ratio Si/C in Deposit to that in Toner) | Image deletion A | Image deletion B | Evaluation 2 Image deletion B |
| Exp. 1 | 1 | 0.107 (5.1) | G4 | G3 | G2 |
| Exp. 2 | 2 | 0.110 (5.2) | G4 | G4 | G2 |
| Exp. 3 | 3 | 0.111 (5.3) | G5 | G4 | G3 |
| Exp. 4 | 4 | 0.108 (5.1) | G5 | G4 | G3 |
| Exp. 5 | 5 | 0.109 (5.2) | G5 | G5 | G4 |
| Exp. 6 | 6 | 0.112 (5.3) | G5 | G5 | G4 |
| Exp. 7 | 7 | 0.113 (5.4) | G5 | G5 | G4 |
| Exp. 8 | 8 | 0.110 (5.2) | G5 | G5 | G4 |
| Exp. 9 | 9 | 0.113 (5.4) | G5 | G5 | G4 |
| Exp. 10 | 10 | 0.111 (5.3) | G5 | G5 | G5 |
| Exp. 11 | 11 | 0.112 (5.3) | G5 | G5 | G5 |
| Exp. 12 | 12 | 0.110 (5.2) | G5 | G5 | G5 |
| Exp. 13 | 14 | 0.114 (5.4) | G5 | G5 | G5 |
| Exp. 14 | 15 | 0.107 (5.1) | G5 | G5 | G4 |
| Exp. 15 | 16 | 0.110 (5.2) | G5 | G5 | G4 |
| Exp. 16 | 17 | 0.109 (5.2) | G5 | G5 | G4 |
| Exp. 17 | 18 | 0.071 (3.4) | G3 | G3 | G3 |
| Exp. 18 | 19 | 0.024 (1.1) | G5 | G3 | G2 |
| Exp. 19 | 20 | 0.031 (2.8) | G5 | G3 | G2 |
| Exp. 20 | 22 | 0.112 (5.3) | G5 | G5 | G5 |
| Exp. 21 | 23 | 0.033 (1.6) | G5 | G3 | G2 |
| Exp. 22 | 24 | 0.032 (1.5) | G4 | G3 | G2 |
| Exp. 23 | 25 | 0.067 (3.2) | G5 | G4 | G3 |
| Exp. 24 | 26 | 0.080 (3.8) | G5 | G4 | G3 |
| Exp. 25 | 27 | 0.087 (4.1) | G5 | G5 | G4 |
| Exp. 26 | 28 | 0.101 (4.8) | G5 | G5 | G4 |
| Exp. 27 | 29 | 0.101 (4.8) | G5 | G5 | G4 |
| Exp. 28 | 30 | 0.087 (4.1) | G5 | G5 | G4 |
| Exp. 29 | 31 | 0.080 (3.8) | G5 | G4 | G3 |

TABLE 5-continued

| | Toner No. | Evaluation 1: Content Ratio Si/C in Deposit at Cleaning Blade (Ratio of Ratio Si/C in Deposit to that in Toner) | Evaluation 1: Image deletion A | Evaluation 1: Image deletion B | Evaluation 2 Image deletion B |
|---|---|---|---|---|---|
| Exp. 30 | 32 | 0.087 (4.1) | G5 | G4 | G3 |
| Exp. 31 | 33 | 0.067 (3.2) | G5 | G4 | G3 |
| Exp. 32 | 34 | 0.031 (2.8) | G4 | G3 | G2 |
| Exp. 33 | 35 | 0.067 (3.2) | G4 | G3 | G2 |
| Comp. Exp. 1 | 21 | 0.112 (5.3) | G4 | G1 | G1 |

In Table 5, the abbreviation of "Exp." denotes "Example number" and the abbreviation of "Comp. Exp." denotes "Comparative Example number".

An examination is made in the case of using the toner 13 as Comparative Example 2. Because the scattering of a toner is observed on fine line parts so that the image deletion of "A" relating to the above evaluation can not be evaluated, the same evaluation as that in other examples and comparative examples are not made.

From the above results, it is found that image deletion is more suppressed in the present examples in which silica particles containing a chlorine compound are applied as an external additive than the comparative examples.

It is also found that image deletion is more suppressed in Examples 12 and 13 in which a pigment having an azo group is applied than Examples 14, 15 and 16 in which other pigments are applied.

Also, it is found that when the content of Si in a deposit of the cleaning blade is designed to be higher than the content of Si in the toner, image deletion is more suppressed than when the content of Si in a deposit of the cleaning blade is designed to be lower than the content of Si in the toner.

It is also found from the evaluations 1 and 2 that image deletion is more suppressed in the case of including the cleaning roll for charge member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming method comprising:

charging a surface of an image holding member;

forming an electrostatic charge image on the surface of the image holding member charged by the charging;

developing the electrostatic charge image formed on the image holding member as a toner image by a toner comprising toner particles having residual ammonium ions and silica particles containing a chlorine compound as an external additive, wherein an amount of the residual ammonium ions is from 0.01 ppm to 20 ppm with respect to an amount of the toner particles;

transferring the toner image formed on the image holding member onto a transfer-receiving body; and fixing the toner image transferred onto the transfer-receiving body.

2. The image forming method according to claim 1, further comprising, after transferring the toner image, cleaning the surface of the image holding member by a cleaning unit comprising a cleaning blade that contacts with the surface of the image holding member, a Si content in a deposited material which is deposited in a part of the cleaning blade that contacts with the image holding member being higher than a Si content in the toner for developing an electrostatic charge image.

3. The image forming method according to claim 2, the Si content in the deposited material which is deposited in the part of the cleaning blade that contacts with the image holding member being at least two times higher than the Si content in the toner for developing an electrostatic charge image.

4. The image forming method according to claim 1, the charging being a charging that charges the surface of the image holding member via a contact-mode charging member having a surface layer comprising an epichlorohydrin rubber.

5. The image forming method according to claim 4, further comprising cleaning a surface of the charging member by using a cleaning member that contacts with the surface of the charging member.

* * * * *